United States Patent [19]

Waschulewski

[11] 4,311,888

[45] Jan. 19, 1982

[54] POSITION SENSOR

[76] Inventor: Hans-Georg Waschulewski, Danziger Strasse 17, 4020 Mettmann, Fed. Rep. of Germany

[21] Appl. No.: 11,330

[22] Filed: Feb. 12, 1979

[30] Foreign Application Priority Data

Feb. 13, 1978 [DE] Fed. Rep. of Germany ..... 2806002

[51] Int. Cl.[3] ..... H01H 1/06

[52] U.S. Cl. ..... 200/52 R; 200/277; 340/686; 417/212

[58] Field of Search ..... 200/11 R, 11 J, 11 K, 200/52 R, 61.41, 61.42, 61.91, 251, 61.39, 16 C, 16 D, 11 DA, 277; 340/686, 687, 603, 679, 671, 670, 672; 417/212

[56] References Cited

U.S. PATENT DOCUMENTS

| | | | |
|---|---|---|---|
| 2,464,184 | 3/1949 | Pearce | 200/16 C |
| 3,218,428 | 11/1965 | Gauthier | 200/251 |
| 3,294,429 | 12/1966 | Johnson | 200/11 J |
| 3,757,060 | 9/1973 | Ianuzzi et al. | 200/277 |
| 3,772,486 | 11/1973 | Wilentchik | 200/16 C |
| 3,958,090 | 5/1976 | Garcia | 200/277 |

FOREIGN PATENT DOCUMENTS

| | | | |
|---|---|---|---|
| 2206744 | 8/1972 | Fed. Rep. of Germany | 200/11 J |
| 1065887 | 5/1954 | France | 200/52 R |

*Primary Examiner*—Gene Z. Rubinson
*Assistant Examiner*—Morris Ginsburg
*Attorney, Agent, or Firm*—Laney, Dougherty, Hessin & Beavers

[57] ABSTRACT

A position sensor includes first and second parts rotatable relative to each other. The first part includes first and second half-ring conductors insulated from each other. The conductors define a sliding surface and the ends of the conductors are spaced to define a slot interrupting the sliding surface. The second part includes a spherical ball closely received in a bore normal to said sliding surface. A spring resiliently urges the ball into said slot to make contact between the two conductors.

7 Claims, 2 Drawing Figures

POSITION SENSOR

BACKGROUND OF THE INVENTION

1. Field of the Invention

The invention relates to a position sensor for making electric contact in a predetermined relative position of two parts movable relative to each other.

2. Prior Art

Position sensors are known wherein a cam is connected to a rotatable part. A transmission rod guided for longitudinal movement is arranged to be displaced by the cam as a function of the rotary movement. The transmission rod actuates an electric switch, which makes a snap motion between two switch positions. Such known position sensors suffer from disadvantages which are adverse to their use in certain applications.

The cam has a cam lobe arranged to displace the transmission rod. To this end the inertia of the transmission rod has to be overcome. When the sensed rotary movement is very fast, for example with manual actuation, it may happen that the transmission rod will not give way quick enough and the cam lobe will thus strike against the end of the transmission rod, whereby damage either of the cam lobe or of the transmission rod may be caused.

Furthermore, position sensors of this type have an inevitable switching hysteresis due to the snap action of the electric switch. An angular displacement, which is not negligible, exists between the switching-on point and the switching-off point, and, within this range, the switch position of the switch is independent of the position of the cam. The actuating movement of actuating this snap mechanism is transmitted correspondingly to this snap mechanism through mechanical transmission means, i.e., the cam lobe and transmission rod. If the hysteresis of the position sensor were to be reduced by appropriate design of the snap mechanism, this would make sense only, if the precision of the transmission mechanism were increased to the same extent. Only then would an exact relation between the switching point of the snap mechanism and the rotary movement of the cam and of a part connected thereto exist.

These disadvantages of prior art position sensors have adverse affects, for example, when one of the movable parts is the housing, and the other one of the movable parts is the actuator shaft, of a hydrostatic variable-output pump, wherein a signal has to be provided in the zero-stroke position of the variable output pump. In this zero-stroke position, the variable-output pump has a discharge volume of zero. The hydrostatic variable-output pump may be part of a hydrostatic propulsion drive system in a construction machine, for example in a road roller. The hydrostatic variableoutput pump is driven by an internal combustion engine. The fluid under pressure thus delivered by the variable-output pump is supplied to hydraulic motors, by means of which the road roller is driven. The idling position of this propulsion drive is represented by the zero-stroke position of the variable-output pump. In this position, for example, the internal combustion engine may be started. If the variable-output pump is not exactly in its zero-stroke position, when the internal combustion engine is started, there will be delivery of fluid under pressure, whereby the rod roller is driven unintentionally. This may result in accidents. In this case it is desirable to provide an interlocking means which prevents starting of the engine or transmission of the propulsion drive, if the variable-output pump is not exactly in its zero-stroke position.

Another case where a signal indicating the zero-stroke position of the variable-output pump in a road roller or the like is required is in a safety device by which the road roller is braked in an emergency situation. This may be done by shunting the inlet and outlet ports of the variable-output pump and by shutting the ports of the hydraulic motors off. This may, however, also be done by applying a mechanical braking device. In such cases it is necessary to provide a re-activation blocking device, which prevents reactivation of the propulsion drive or releasing of the braking device as long as the control lever for the propulsion, which is connected to the actuator shaft of the hydrostatic variable-output pump, has not yet been returned to its idling position and the variable-output pump is not in its zero-stroke position. In this situation, accidents may be caused by releasing the brake though the variable-output pump has not been returned exactly to its zero-stroke position.

The fault that the starting procedure may be released or the re-activation blocking device may be disabled, with the variable-output pump not exactly in its zero-stroke position, occurs with a position sensor of the prior art type mentioned above, because with the prior art sensor, the setting of the variable-output pump may vary about the zero-stroke position within the hysteresis of the position sensor. It has been found that this fault and the risks caused thereby are not negligible.

SUMMARY OF THE INVENTION

The invention provides a position sensor of the type defined in the beginning such that damage of the position sensor even with fast relative movement of the parts is avoided, that practically no switching hysteresis will occur and that no disadvantageous mechanical transmission means are required.

According to the invention this purpose is achieved in that a first part of the position sensor comprises two conductors insulated from each other, which form a sliding surface, said surface being interrupted between the conductors by a slot. A contact piece is guided in the second part and engages the sliding surface resiliently, said contact piece being guided on a path intersecting the slot, during relative movement of the parts, and being designed to jump into the slot.

With the relative movement of the two parts the contact piece is moved over the sliding surface. In an exactly defined point the contact piece jumps into, i.e., is resiliently urged into, the slot. At this point the electric connection between the two conductors is established. As soon as this point has been passed, the contact piece is released from the detent within the slot and thereby breaks the electric connection. By making the contact piece jump into the slot and by releasing this detent again upon further relative movement of the parts, the contact will be made theoretically in one single exactly defined point only. Switching hysteresis may be caused only by the clearance with which the contact piece is guided in the second part. This clearance may be made very small. There is practically no range in which the contact is maintained independent of the relative movement of the parts. This would be the case, for example, if a contact piece not jumping into the slot would bridge the slot with a plane surface sliding on a plane sliding surface and would thus establish the connection between the two conductors.

It is, therefore, an object of the present invention to provide an improved position sensor.

Another object of the present invention is to provide an electro-mechanical position sensor having a very low switching hysteresis.

Yet another object of the present invention is to provide a reliable and durable position sensor for sensing a relative position of two mutually rotatable components durisng fast relative movement between said two components.

Other and further objects, features and advantages of the present invention will be apparent to those skilled in the art upon a reading of the following disclosure taken in conjunction with the accompanying drawings.

Figure 1:
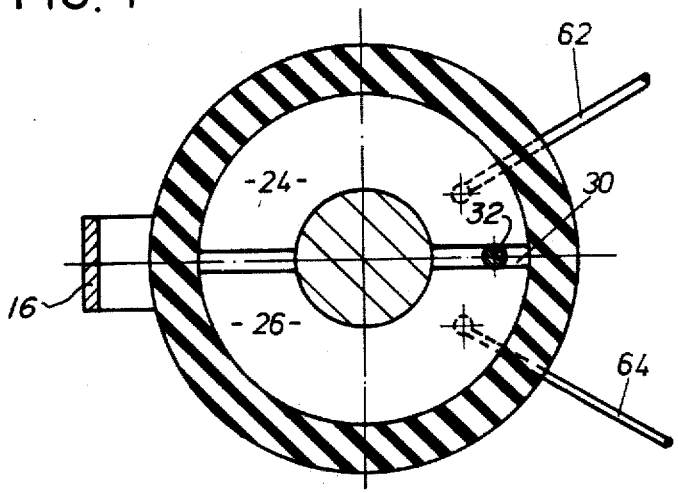
FIG. 1 is a cross-sectional view, taken along line I—I of FIG. 2, of a position sensor of the invention.

FIG.s 2 is a longitudinal sectional view of a position sensor of the invention.

DETAILED DESCRIPTION OF THE PREFERRED EMBODIMENTS

The position sensor illustrated serves to signalize the zero-stroke position of a hydrostatic variable-output pump 10. To this end, the position sensor, which is generally designated 12, comprises a first part 14, which is attached to a housing 18 of the variable-output pump 10 through a bracket 16, and a second part 20, which is coupled to an actuator shaft 22 of the variable-output pump 10.

Figure 2:
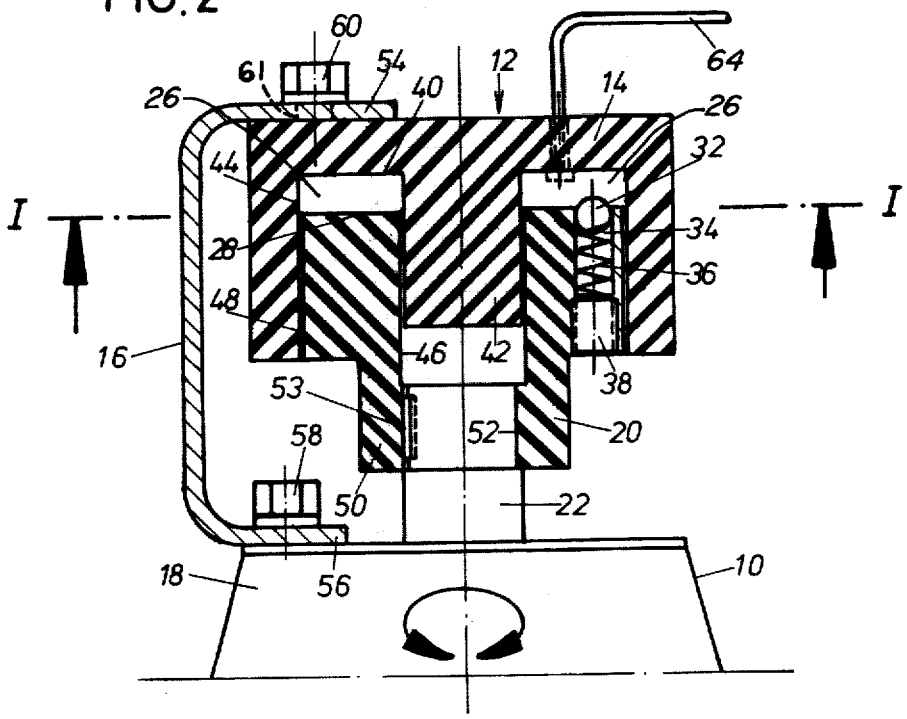

The first part 14 comprises first and second conductors 24 and 26, respectively, which form and define sliding surface 28 (FIG. 2) which is interrupted between the conductors 24 and 26 by a slot 30.

A contact piece 32 in the form of a ball is guided in the second part 20, which is movable relative to the first part. The contact piece 32 engages the sliding surface 28 resiliently and is guided along a path intersecting the slot, when the parts 14 and 20 are moved relative to each other. The contact piece is a spherical ball the diameter of which is larger than the width of the slot 30. Preferably, a radius of ball 32 is also greater than the width of the slot 30. The ball 32 is guided with nearly no clearance, i.e., is closely received, within a bore 34 of the second part. This bore 34 extends substantially normal to the sliding surface 28 of the first part 14 and contains a coil spring 36, which engages an abutment. The bore 34 is a through bore, and the abutment is formed by the end face of a set screw 38, which is screwed into the bore 34 at the end remote from the sliding surface 28. Spring 36 has a first end engaging ball 32 and a second end engaging said abutment of set screw 38. The ball 32 is resiliently urged into slot 30 by spring 36 when the path of ball 32 intersects slot 30.

The two parts 14 and 20 are mounted for mutual rotation. The first part 14 is pot-shaped and has a central bearing pin 42 projecting from the bottom 40 of the pot-shaped first part 14 into the interior thereof. First and second conductors 24 and 26 are first and second flat half-rings, respectively, which are located on the bottom 40 of the pot-shaped first part 14 in the annular space between the inner surface 44 of the pot-shaped first part 14 and the central bearing pin 42. First and second half-rings 24 and 26 define the slot 30 between their end faces.

The second part 20 is mounted for rotation on the central pin 42 by means of a bearing bore 46. Second part 20 includes a cylindrical peripheral surface 48, which defines a narrow annulus with the inner surface 44 of the pot-shaped first part 14. The contact piece, i.e., the ball 32, is guided in the bore 34, provided as an off-center axial bore, of the second part 20. The second part 20 includes a hub 50 axially aligned with the bearing bore 46 and having a central axial bore 52, which has coupling means 53 on its inner surface for non-rotatably coupling with a rotating pin, for example the actuator shaft 22 of the variable-output pump 10. Actuator shaft 22 may be referred to as a rotatable component of a device, e.g., pump 10, upon which position sensor 12 is to be mounted. The coupling means 53 may comprise a spline or a groove-and-tongue joint.

The U-shaped bracket 16 is attached with a first leg 54 to the first part 14 and a second leg 56 of bracket 16 being adapted to be attached to the housing 18, relative to which the actuator shaft 22 is rotatably mounted. The bracket 16 is screwed to the housing 18 by means of a screw 58. The brakcet 16 is attached to the first part 14 by means of a screw 60, which is screwed into the first part 14 and passes through an oblong curved slot 61 provided in the first leg 54 of the bracket 16. Slot 61 is curved about the axis of rotation of second part 20.

The contact signal is transferred through first and second lines 62 and 64 which are connected to the first and second conductors 24 and 26, respectively. The adjustment of the position sensor 12 described may be made by, at first, setting the variable-output pump 10 exactly on zero-stroke. This state can be recognized by the fact, that the variable-output pump 10 does not deliver any fluid under pressure. Then, with screw 60 loosened, the first part 14 is rotated about the axis of rotation until the signal is generated at lines 62 and 64, i.e., the ball 32 has jumped into the slot 30. This adjustment is permitted by the slot 61 in the bracket 16 with loosened screw 60. Then the screw 60 is tightened, whereby a signal is generated with zero-stroke position. This signal generation in the zero-stroke position is then reproducible practically without hysteresis.

When the pump 10 is moved quickly through the zero-stroke position, only a short signal will be generated. Provision can be made that such a short signal will not yet cause releasing of the re-activation blocking device of the safety device described in the beginning, because then the propulsion drive would already have been set on a finite propulsion speed again.

Since the ball 32 jumps into the slot 30 with a shallow portion only, no damage of the mechanism can occur even with quick movement of the actuator shaft 22.

Thus, the present invention is well adapted to carry out the objects and attain the ends and advantages mentioned as well as those inherent therein. While numerous changes in the construction and arrangement of parts can be made by those skilled in the art, such changes are encompassed within the spirit of this invention as defined by the appended claims.

What is claimed is:

1. A position sensor comprising:

a first part including first and second conductors insulated from each other, said conductors defining a sliding surface interrupted by a slot between the conductors;

a second part, movable relative to said first part, including a contact piece guided in said second part and resiliently engaging said sliding surface, said contact piece being guided during relative movement of said first and second parts on a path intersecting said slot so that said contact piece is resiliently urged into said slot;

wherein said first part is pot-shaped, having a central bearing pin projecting from a bottom of said pot-shaped first part into an interior of said pot-shaped first part, said first and second conductors including first and second flat half-rings, respectively, said half-rings being located adjacent said bottom of said pot-shaped first part in an annular space between an inner surface of said pot-shaped first part and said central bearing pin, said slot being defined between end faces of said first and second half-ring; and wherein said second part is rotatably mounted on said central bearing pin by means of a bearing bore disposed in said second part, said second part further including a cylindrical peripheral surface defining a narrow annulus between said peripheral surface of said second part and said inner surface of said pot-shaped first part, and said contact piece being closely received in an off-center axial bore disposed in said second part.

2. The sensor of claim 1 wherein:

said contact piece includes a ball having a diameter larger than a width of said slot.

3. The sensor of claim 2 wherein:

a radius of said ball is greater than said width of said slot.

4. The sensor of claim 1 wherein:

said second part includes a hub axially aligned with said bearing bore, said hub including a central axial bore with a coupling means on an inner surface thereof for non-rotatable coupling of said second part with a rotatable component of a device upon which said position sensor is to be mounted.

5. The sensor of claim 4 further comprising :

a U-shaped bracket, including first and second legs, said first leg being connected to said first part, and said second leg including a means for connection thereof to a housing of said device upon which said position sensor is to be mounted, said rotatable component being rotatably mounted within said housing.

6. The sensor of claim 5 wherein:

said first leg of said bracket includes an oblong slot, said first leg being connected to said first part by means of a screw threadedly connected to said first part and disposed through said slot.

7. A position sensor comprising:

a first part including first and second conductors insulated from each other, said conductors defining an annular planar sliding surface interrupted by a radially extending slot between the conductors, said first and second conductors including first and second edges, respectively, on opposite sides of said slot;

a second part, rotatable relative to said first part and having a bore disposed therein substantially normal to said sliding surface of said first part, and including a conducting ball closely received in said bore and resiliently engaging said sliding surface, said conducting ball having a diameter greater than a width of said slot and said conducting ball being guided by said second part during relative rotational movement of said first and second parts on a circular path intersecting said radially extending slot so that said conducting ball is resiliently urged into said slot; and wherein said first and second conductors and said conducting ball are so arranged and constructed that when said conducting ball is simultaneously engaged with both said first and second conductors the only parts of said first and second conductors engaged by said conducting ball are said first and second edges each of which are engaged by said conducting ball only at a point.

* * * * *